US005110108A

United States Patent [19]

Müller

[11] Patent Number: 5,110,108

[45] Date of Patent: May 5, 1992

[54] SHEET TRANSPORTING APPARATUS

[75] Inventor: Hans Müller, Zofingen, Switzerland

[73] Assignee: GRAPHA-Holding AG, Hergiswil, Switzerland

[21] Appl. No.: 458,078

[22] Filed: Dec. 28, 1989

[30] Foreign Application Priority Data

Feb. 3, 1989 [CH] Switzerland ..... 389/89

[51] Int. Cl.[5] ..... B65H 29/68

[52] U.S. Cl. ..... 271/69; 271/82; 271/204; 271/315

[58] Field of Search ..... 271/69-70, 271/72, 82, 83, 186-187, 204-206, 315

[56] References Cited

U.S. PATENT DOCUMENTS

| | | | |
|---|---|---|---|
| 2,031,136 | 2/1936 | Sewick | 271/315 |
| 4,058,202 | 11/1977 | Reist et al. | 271/295 |
| 4,390,093 | 6/1983 | Chard, Jr. et al. | 271/204 |
| 4,399,905 | 8/1983 | Lance et al. | 271/204 |
| 4,555,101 | 11/1985 | Stobb | 271/12 |
| 4,732,374 | 3/1988 | Honegger | 271/314 |
| 4,813,662 | 3/1989 | Merwarth et al. | 271/187 |

*Primary Examiner*—David H. Bollinger

*Attorney, Agent, or Firm*—Peter K. Kontler

[57] ABSTRACT

Apparatus for advancing sections of newspapers has a first conveyor with equidistant grippers which deliver a series of suspended sections to a transfer conveyor. The latter delivers successive sections into successive pockets of a turret-shaped conveyor and comprises a driven shaft carrying two annuli of bearings for the stubs of two sets of plate-like clamping members. Each clamping member of one set cooperates with a clamping member of the other set to engage a section which is delivered by an oncoming gripper and to transfer the thus engaged section into a pocket of the turret-shaped conveyor. The clamping members of each set are pivotable relative to the shaft and orbit about the shaft when the latter is driven to advance the clamping members along an endless path. The devices for pivoting the two sets of clamping members during predetermined stages of each revolution of the shaft employ exchangeable stationary cams and followers provided on the respective sets of clamping members to track the cams. Pivotability of the clamping members relative to the shaft renders it possible to compensate for differrences between the speeds of the first conveyor and turret-shaped conveyor.

16 Claims, 3 Drawing Sheets

SHEET TRANSPORTING APPARATUS

BACKGROUND OF THE INVENTION

The invention relates to apparatus for manipulating sheets, particularly printed sheets such as front page or main sections or inserts of newspapers, signatures and the like. Still more particularly, the invention relates to improvements in sheet transporting apparatus of the type wherein a first conveyor advances a series of sheets along a first path, a second conveyor serves to advance the sheets of the series along a second path, and a third conveyor serves to transfer successive sheets of the series from the first conveyor to the second conveyor.

Commonly owned copending patent application Ser. No. 07/317,737 and now U.S. Pat. No. 5,050,851 discloses an apparatus wherein a first conveyor advances a series of sheets in suspended position for deposition of successive sheets into receptacles (e.g., in the form of pockets) forming part of a second conveyor in an inserting machine. The first conveyor has grippers which support discrete sheets of the series in suspended position, and a third conveyor which serves to transfer sheets from successive grippers of the first conveyor into successive pockets of the second conveyor comprises or constitutes a ramp or chute along which the sheets slide on their way from a gripper into the registering pocket of the second conveyor.

A drawback of the just described apparatus is that it cannot rapidly transfer relatively thin and/or relatively large sheets with a required degree of reliability. The reason for such unreliability of the apparatus in connection with the transfer of relatively thin (readily flexible) and/or relatively large sheets is that the orientation of sheets relative to the respective grippers and/or relative to the ramp or chute is likely to change due to the resistance of air in the path of movement of rapidly advancing sheets. On the other hand, it is desirable to deliver successive sheets of a short or long series in suspended position because this facilitates their transfer into the receptacles of the second conveyor, e.g., into the aforementioned inserting machine for assembly of newspapers or the like.

OBJECTS OF THE INVENTION

An object of the invention is to provide a sheet advancing apparatus which is more versatile than heretofore known apparatus.

Another object of the invention is to provide an apparatus which can advance and transfer relatively thin and/or relatively large sheets with the same facility and with the same degree of reliability as medium sized sheets which are less likely to change their orientation due to the resistance of air when the sheets are advanced at an elevated speed.

A further object of the invention is to provide a novel and improved conveyor which can transfer rapidly advancing sheets of a short or long series of sheets into successive receptacles of an inserting machine or another sheet processing machine.

An additional object of the invention is to provide the transfer conveyor with novel and improved sheet engaging and transferring units.

Still another object of the invention is to provide a production line, particularly for the gathering of newspaper sections, which embodies the above outlined apparatus.

A further object of the invention is to provide an apparatus which can dispense with the chutes or ramps of conventional apparatus.

Another object of the invention is to provide the apparatus with a transfer conveyor which is constructed, assembled and operated in such a way that it can reliably accept, temporarily retain and deliver sheets which are so thin and/or so large that they are likely to be reoriented by surrounding air during transport toward and at the transfer station.

An additional object of the invention is to provide an apparatus which can be installed in existing production lines as a superior substitute for heretofore known apparatus.

Another object of the invention is to provide a transfer conveyor which can be used in existing sheet advancing apparatus as a superior substitute for conventional transfer means.

SUMMARY OF THE INVENTION

The invention is embodied in an apparatus for manipulating sheets, particularly printed sheets such as sections of newspapers. The improved apparatus comprises a first conveyor (e.g., an endless chain conveyor) having means for advancing a series of sheets in a first direction at a predetermined frequency and along a first path, a second conveyor (e.g., a turret) having means for advancing the series of sheets in a second direction at the predetermined frequency and along a second path, and a third conveyor which comprises means for transferring successive sheets of the series from the advancing means of the first conveyor to the advancing means of the second conveyor. In accordance with a feature of the invention, the transferring means resembles or constitutes a fan wheel and comprises a carrier (e.g., including a substantially horizontal shaft) which is rotatable about a first axis, and a plurality of sheet clamping units mounted on the carrier for orbital movement about the first axis in response to rotation of the carrier. Each unit comprises a pair of clamping members which define a sheet receiving pocket and at least one clamping member of each unit is pivotable relative to the other clamping member of the respective pair of clamping members and/or relative to the carrier about a discrete second axis which is at least substantially parallel to the first axis. The transferring means further comprises means for pivoting the at least one clamping member of each clamping unit relative to the other clamping member of the respective unit and/or relative to the carrier during at least one predetermined portion of each revolution of the carrier about the first axis.

The advancing means of the first conveyor can be designed to advance the sheets of the series in suspended position, and the third conveyor can be disposed at a level beneath the first path but above the second path. The second direction can extend substantially counter to the first direction. The axis of the aforementioned shaft of the carrier for the clamping units coincides with the first axis.

The other clamping member of each clamping unit is preferably pivotable relative to the respective at least one first clamping member about a third axis which is at least substantially parallel with the first axis (and can coincide with the respective discrete second axis), and such transferring means further comprises means for pivoting the other clamping member of each clamping unit relative to the at least one clamping member of the same unit and/or relative to the carrier during at least one predetermined portion of each revolution of the carrier about the first axis and independently of the respective at least one clamping member. At least one clamping member of each clamping unit can comprise or constitute a plate.

The transferring means preferably comprises discrete bearing means for each clamping member of each clamping unit, and each such clamping member preferably comprises a shaft (e.g., a stub shaft) which is turnably mounted in the respective bearing means.

At least one of the pivoting means can comprise cam means and follower means provided on the respective clamping members and arranged to track the cam means. The cam means can include a stationary cam, e.g., a cam having a peripheral cam face for the follower means of the respective clamping members. Such transferring means can further comprise springs or other suitable means for yieldably biasing the followers toward the peripheral surface of the cam. Alternatively, the cam can be provided with an endless cam groove for the follower means. The apparatus further comprises a support for the cam, and the latter is detachably and exchangeably mounted in or on the support.

Portions of clamping members of each clamping unit can be inclined forwardly in the direction of rotation of the carrier in order to facilitate acceptance of sheets from the advancing means of the first conveyor and/or the delivery of sheets to the advancing means of the second conveyor and/or deep penetration of sheets into the pockets of the clamping units.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
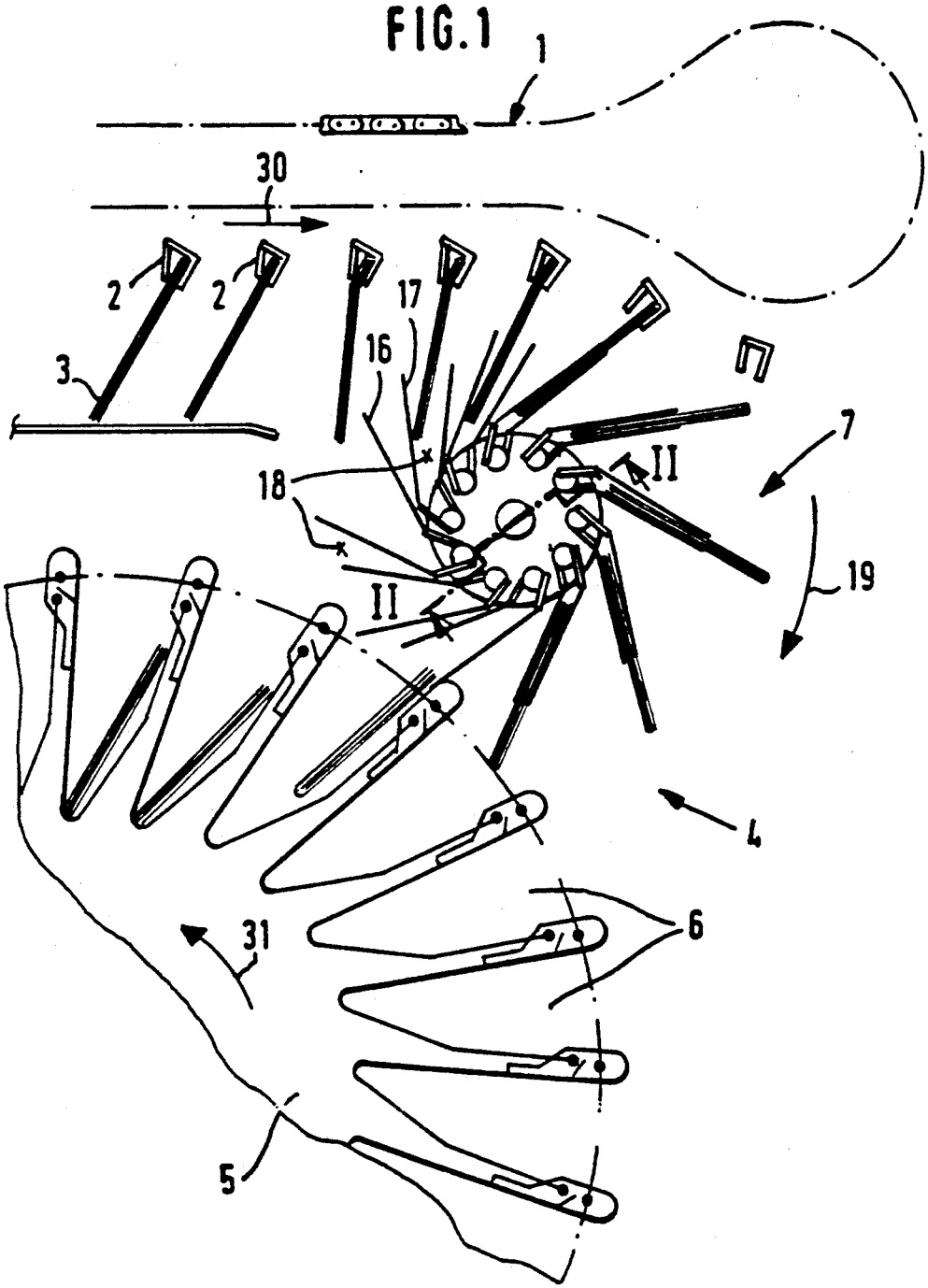
FIG. 1 is fragmentary schematic front elevational view of an apparatus which embodies one form of the invention and wherein the rotary fan wheel-shaped third conveyor is disposed at a level between the first and second conveyors.

The apparatus which is shown in FIG. 1 comprises a first conveyor 1 (e.g., an endless chain conveyor) with equidistant advancing means in the form of grippers 2 which releasably support a series of sheets 3 in suspended position. Each sheet 3 can constitute the front or main section or an insert of a newspaper which is to be assembled prior to shipment to distributors. The manner in which the grippers 2 can be opened at a receiving station to accept discrete sheets 3, and in which the grippers can be opened again to release the respective sheets at a transfer station beneath the lower reach of the endless first conveyor 1 is known and forms no part of the present invention. Reference may be had to numerous United States and foreign patents of the assignee of the present application. The direction in which the lower reach of the conveyor 1 advances the series of equidistant sheets 3 along a substantially horizontal path is indicated by an arrow 30. The grippers 2 receive sheets 3 from a rotary printing press or from another suitable source.

A rotary turret-shaped second conveyor 5 of the improved apparatus defines an endless second path for advancement of successive sheets 3 of the series in a second direction (arrow 31) substantially counter to the first direction. The advancing means of the second conveyor 5 comprises pockets 6 each of which can receive a sheet 3 at an inserting station 4 which the conveyor 5 defines with a substantially fan wheel-shaped third conveyor 7 having means for transferring successive sheets 3 of the series from successive grippers 2 into successive pockets 6. The exact nature of the inserting machine including the turret-shaped second conveyor 5 forms no part of the present invention; reference may be had to commonly owned copending patent application Ser. No. 07/317,737 filed Mar. 2, 1989 by Albert Eugster for "Machine for placing inserts between the panels of folded sheets". The arrangement is such that each sheet 3 which is taken over by the third conveyor 7 advances along an arc of approximately 180° prior to being dropped into the adjacent pocket 6 of the conveyor 5. The direction in which the conveyor 7 transports sheets 3 from the lower reach of the conveyor 1 into successive pockets 6 of the conveyor 5 is indicated by an arrow 19.

A feature of the invention resides in the provision of sheet transferring means forming part of the third conveyor 7 and serving to deliver sheets 3 into successive pockets 6 irrespective of the extent of flexibility and/or the dimensions of such sheets, i.e., regardless of the resistance which air offers to advancement of sheets with the grippers 2 and/or with the clamping units (each including two cooperating clamping members 16, 17) of the conveyor 7.

Figure 2:
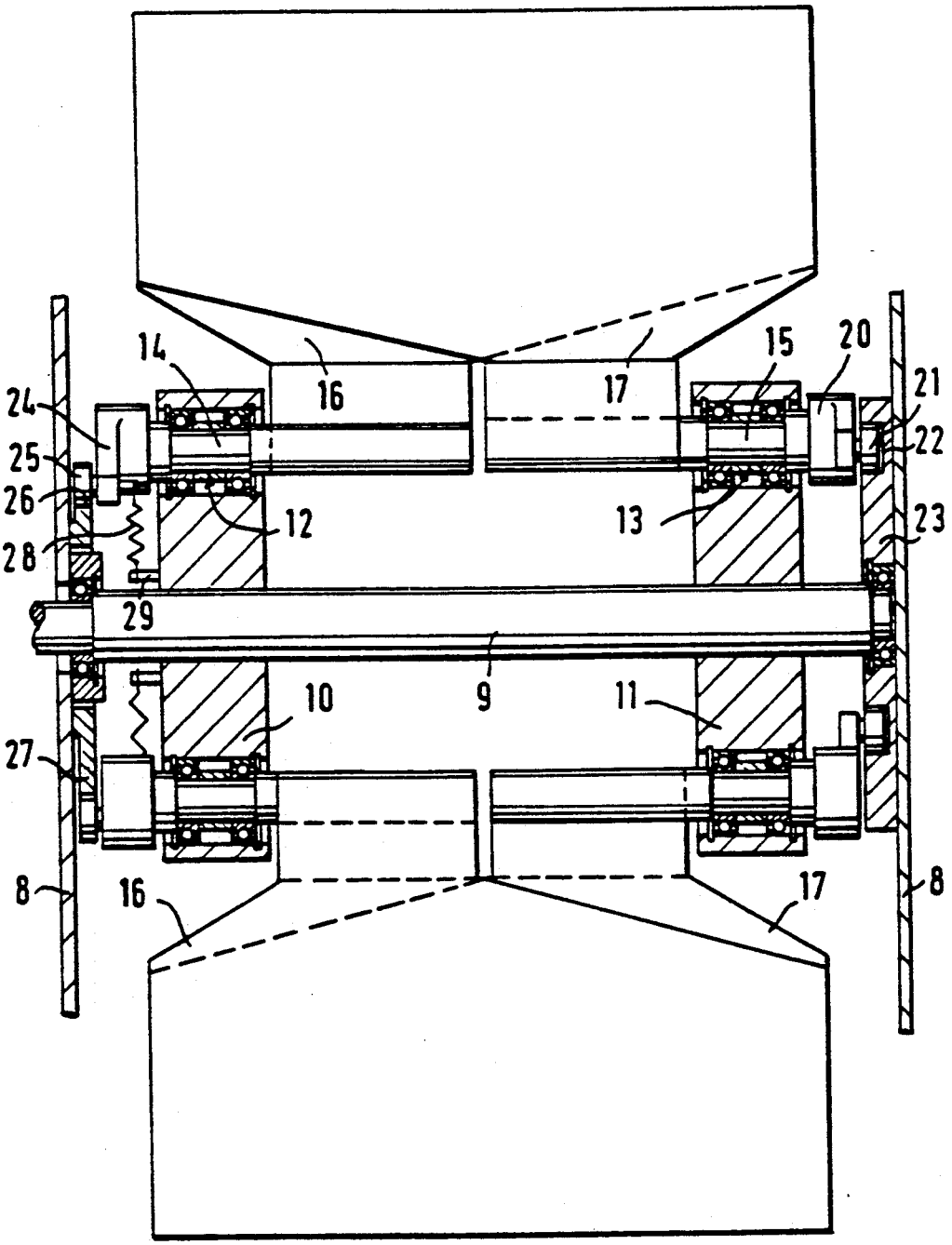
FIG. 2 is an enlarged substantially axial sectional view of the third conveyor substantially as seen in the direction of arrows from the line II—II of FIG. 1.

The transferring means of the conveyor 7 includes a support in the form of a housing 8 (FIG. 2) for an elongated carrier 9 in the form of a shaft which is journalled in bearings provided therefor in two spaced-apart walls of the support 1 to rotate about a horizontal first axis. The means for rotating the shaft 9 in the direction of arrow 19 in synchronism with movements of the conveyors 1 and 5 can include a prime mover and a chain or belt transmission, not shown. The support or housing 8 can form part of the inserting machine which includes the conveyor 5.

The carrier 9 supports and transmits torque to two axially spaced apart discs 10, 11 for annuli of antifriction bearings 12, 13, respectively. Each of these discs carries ten equidistant bearings, and each bearing 12 in the disc 10 is coaxial with a bearing 13 in the disc 11. The clamping members 16 resemble or constitute plates and have stub shafts 14 in the bearings 12; such stub shafts are coaxial with stub shafts 15 forming part of the associated plate-like clamping members 17 and being rotatably journalled in the respective bearings 13. The axes of the stub shafts 14 are parallel to the axis of the carrier 9, the same as the axes of the stub shafts 15. The clamping units (each of which includes a clamping member 16 and a clamping member 17) define pockets 18 for discrete sheets 3, and such clamping units are caused to orbit about the axis of the carrier 9 when the latter is set in motion by the aforementioned prime mover by way of the chain or belt transmission or any other suitable torque transmitting means. The clamping members 17 are located ahead of the cooperating clamping members 16, as seen in the direction (arrow 19) of rotation of the conveyor 7. The clamping members 16, 17 of each clamping unit are caused to bear against the respective sides of a sheet 3 in the corresponding pocket 18 with a requisite force to ensure predictable transfer of the sheet from the oncoming gripper 2 into the adjacent pocket 6.

The stub shafts 14, 15 of the two sets of clamping members 16, 17 are pivotable in the respective bearings 12, 13 in clockwise and counterclockwise directions and independently of each other, i.e., each clamping member 16 can pivot relative to the carrier 9 and the respective clamping member 17, and vice versa. Such pivotal movements of the clamping members 16, 17 are superimposed upon the orbital movements of the stub shafts 14, 15 about the axis of the carrier 9 when the latter is maintained in rotary motion. The rotary movement of the carrier 9 takes place in synchronism with the movement of grippers 2 in the direction of arrow 30 and with the movement of pockets 6 in the direction of arrow 31.

The means for pivoting the clamping members 17 during predetermined portions of successive revolutions of the carrier 9 comprises a stationary cam 23 which is removably and exchangeably mounted in the adjacent wall of the support 8 and has an endless cam groove 22 for a set of roller followers 21 provided on arms 20 which are rigid or integral with the respective stub shafts 15. The configuration of the cam groove 22 in the stationary cam 23 determines the extent and timing of pivoting of successive clamping members 17 relative to the associated clamping members 16 and relative to the carrier 9. Since the roller followers 21 are permanently confined in the endless groove 22 of the exchangeable cam 23, the angular position of each clamping member 17 with reference to the carrier 9 and with reference to the associated clamping member 16 is determined in advance in each and every angular position of the carrier. Such angular positions of the clamping members 17 can be altered by replacing the illustrated cam 23 with a cam having a different cam groove 22.

The means for pivoting the clamping members 16 relative to the carrier comprises arms 24 provided on the outer end portions of the stub shafts 14, roller followers 25 on the arms 24, and coil springs 28 serving to yieldably bias the roller followers 25 toward the peripheral surface 26 of an exchangeable stationary disc cam 27 separably affixed to the respective wall of the support 8. One end convolution of each coil spring 28 is affixed to a discrete pin 29 on the disc 10, and the other end convolution of each coil spring is connected to a pin on the respective arm 24. The clamping members 16 can yield against the opposition of the respective coil springs 28 to move away from the associated clamping members 17 and to thus increase the width of the radially outermost portions (inlets) of the respective pockets 18. This results or can result in lifting of the roller followers 25 off the peripheral surface 26 of the cam 27. Such pivotability of the clamping members 16 against the opposition of the respective coil springs 28 is desirable and advantageous in order to conform the angular positions of the clamping members 16 to the thickness of the sheets 3. When a relatively thick sheet 3 enters a pocket 18, it causes the respective trailing clamping member 16 to pivot away from the associated leading clamping member 17 and the thus stressed coil spring 28 ensures that the clamping members 16, 17 cooperate to engage and hold the relatively thick sheet 3 with a requisite force for transfer to the inserting station 4. At such time the respective roller follower 25 is actually lifted off the peripheral surface 26 of the cam 27.

Figure 3:
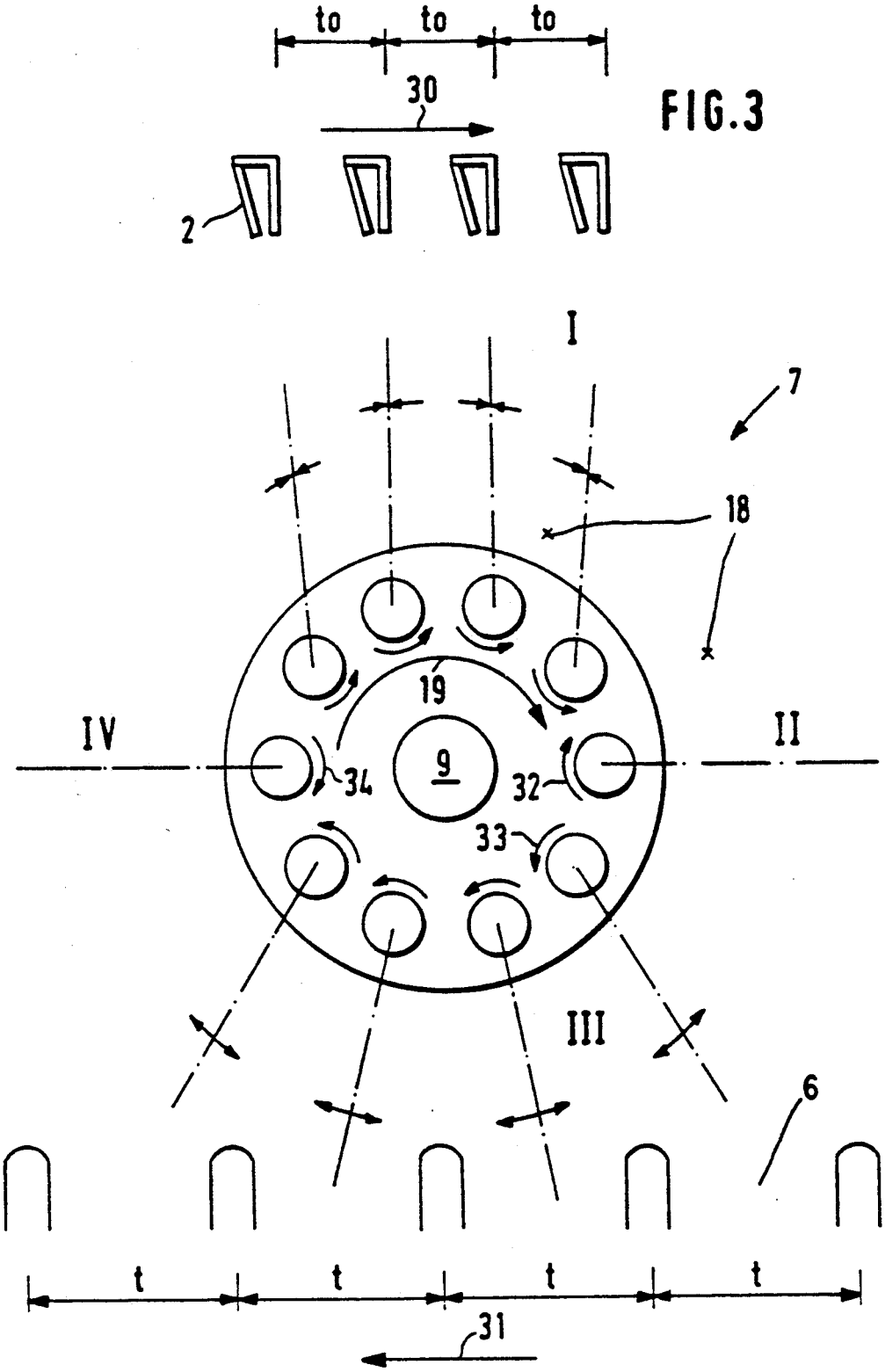
FIG. 3 is a diagrammatic front elevational view of the third conveyor, and further showing certain advancing means of the first and second conveyors.

The operation of the improved apparatus is as follows:

FIG. 3 shows that the pitch to of the grippers 2 forming part of the first conveyor 1 is smaller than the pitch t of the pockets 6 in the second conveyor 5 (the pockets 6 in the lower part of FIG. 3 are shown in a developed view. The conveyor 1 including the grippers 2 is assumed to be in motion in the direction of arrow 30, and the conveyor 5 including the pockets 6 is assumed to be in motion in the direction of arrow 31. The carrier 9 of the third conveyor 7 is rotated in the direction of arrow 19. The clamping units of the conveyor 7 between the level of the sheet-delivering grippers 2 and the level of the sheet-receiving pockets 6 are indicated by discrete phantom lines.

When the members 16, 17 of a clamping unit advance from the section IV into the section I of the endless path of the clamping units about the axis of the carrier 9, the leading clamping member 17 is pivoted forwardly (as seen in the direction of arrow 19) and moves its radially outermost portion away from the associated trailing clamping member 16 to assume an optimum position with reference to the foremost gripper 2 which carries a sheet 3. At the same time, the respective trailing clamping member 16 is or can be pivoted counter to the direction of arrow 19 in order to further increase the width of the inlet of the respective pocket 18. Thus, the cams 23 and 27 ensure that the angular positions of clamping members 16 and 17 forming part of a clamping unit which is about to receive a sheet 3 conform to the pitch to of the grippers 2 at the time the foremost loaded gripper 2 is caused to release the sheet 3 so that the latter drops into the respective pocket 18. As the just discussed clamping unit continues to advance in the direction of arrow 19, its leading clamping member 17 remains in proper orientation with reference to the adjacent gripper 2 while the trailing clamping member 16 gradually pivots in the direction of arrow 19 to engage the rear side of the sheet 3 in the respective pocket 18. This ensures that the clamping members 16, 17 are in force-locking engagement with the sheet 3 not later than when the respective clamping unit completes it advancement along the section I of the endless path about the carrier 9. The arrangement is preferably such that the cam 23 causes the leading clamping member 17 to pivot relative to the carrier 9 at a rate which is required to maintain the radially outermost portion of such leading clamping member in optimum position with reference to the adjacent gripper 2 in order to ensure that, irrespective of its orientation, the sheet 3 which is suspended from the gripper 2 adjacent the leading clamping member 17 is invariably located in the respective pocket 18 and is clamped between the members 16, 17 when such members leave the section I.

The clamping members 16, 17 can extract the sheet 3 from the adjacent gripper 2 and/or the latter is caused to open and release the sheet 3 before the clamping members advance beyond the section I. When a pocket 18 with a sheet 3 therein enters the section II of the endless path of orbital movement of clamping units about the axis of the carrier 9, the corresponding clamping members 16, 17 are caused to pivot in the direction of arrow 32 so as to conform their positions to the pitch t of pockets 6 on the conveyor 5. The clamping unit with a sheet 3 in its pocket 18 then enters the path section III and the corresponding clamping members 16, 17 are caused to pivot in the direction of arrow 33 (i.e., counter to the direction of arrow 32) so that the pocket 18 which contains the sheet 3 remains in register with the adjacent pocket 6 of the conveyor 5 during the entire interval of travel of the pocket 18 along the section III. At the same time, at least one clamping member of the clamping unit is caused to pivot its radially outermost portion away from the other clamping member in order to release the sheet 3 which is free to descend into the registering pocket 6. Opening of the clamping unit is preferably gradual.

The clamping members 16, 17 of a unit which advances beyond the section III to reenter the section IV are caused to pivot in the direction of arrow 34 so that the inlet of the respective pocket 18 is pivoted with reference to the carrier 9 in the direction of arrow 19 in order to ensure that this (empty) pocket 18 assumes an optimum position relative the sheet 3 which is suspended from the oncoming sheet-carrying gripper 2. Proper alignment of the empty pocket 18 with the adjacent suspended sheet 3 is or can be completed when the respective clamping unit reenters the section I.

If the pitch ratio to/t is changed, the cams 23 and 27 are simply replaced with different cams.

FIG. 1 shows that the major (radially outer) portions of the clamping members 16, 17 in each clamping unit are inclined relative to the smaller (radially inner) portions in the direction (arrow 19) of orbital movement of the clamping unit about the axis of the carrier 9. This ensures more satisfactory orientation of the pockets 18 relative to the sheets 3 which are carried by the adjacent grippers 2 during travel of clamping units along the section I of their endless path, and also in more reliable transfer of sheets 3 from the grippers into the adjacent pockets 18. Moreover, such configuration of the clamping members 16, 17 contributes to more reliable delivery of sheets 3 into the substantially radially extending pockets 6 of the conveyor 5.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for manipulating sheets, particularly printed sheets, comprising a first conveyor having a plurality of discrete neighboring means for individually advancing the sheets of a series of sheets in a first direction at a predetermined frequency along a first path; a second conveyor having a plurality of discrete neighboring means for advancing the sheets of said series of sheets in a second direction at said frequency along a second path, the neighboring advancing means of said first conveyor being spaced apart from each other a first distance and the neighboring advancing means of said second conveyor being spaced apart from each other a second distance; and a third conveyor having means for transferring successive sheets of said series from the discrete advancing means of said first conveyor to the discrete advancing means of said second conveyor, said transferring means comprising a carrier rotatable about a first axis, a plurality of discrete neighboring sheet clamping units mounted on said carrier for orbital movement about said axis in response to rotation of said carrier, each of said units comprising a pair of clamping members defining a sheet receiving pocket, at least one clamping member of each pair being pivotable relative to the other clamping member of the respective pair about a discrete second axis which is at least substantially parallel to said first axis, and means for pivoting the at least one clamping member of each of said units relative to the other clamping member of the respective unit during at least one predetermined portion of each revolution of said carrier about said first axis to thereby vary the spacing of said units during said orbital movement so that said spacing corresponds to said first distance during reception of sheets from said first conveyor and that said spacing corresponds to said second distance during transfer of sheets to said second conveyor.

2. The apparatus of claim 1, wherein the advancing means of said first conveyor include means for advancing the sheets of said series in suspended position and said third conveyor is disposed beneath said first path and above said second path.

3. The apparatus of claim 1, wherein said second direction is substantially counter to said first direction.

4. The apparatus of claim 1, wherein said carrier includes a driven shaft having an axis which coincides with said first axis.

5. The apparatus of claim 1, wherein the other clamping member of each of said units is pivotable relative to the respective at least one clamping member about a third axis which is at least substantially parallel to said first axis, said transferring means further comprising means for pivoting the other clamping member of each of said units relative to said carrier during at least one predetermined portion of each revolution of said carrier about said first axis and independently of the respective at least one clamping member.

6. The apparatus of claim 5, wherein at least one clamping member of each of said units includes a plate.

7. The apparatus of claim 5, wherein said transferring means further comprises discrete bearing means for each clamping member of each of said units and each of said clamping members includes a shaft which is turnably mounted in the respective bearing means.

8. The apparatus of claim 7, wherein said shafts are stub shafts.

9. The apparatus of claim 7, wherein said third axes coincide with the respective second axes.

10. The apparatus of claim 5, wherein at least one of said pivoting means comprises cam means and follower means provided on the respective clamping members and arranged to track said cam means.

11. The apparatus of claim 10, wherein said cam means comprises a stationary cam.

12. The apparatus of claim 11, wherein said cam has a peripheral cam face for said follower means and said at least one pivoting means further comprises means for yieldably biasing said follower means toward said cam face.

13. The apparatus of claim 11, wherein said cam has an endless cam groove for said follower means.

14. The apparatus of claim 11, further comprising a support for said cam, said cam being detachably and exchangeably mounted in said support.

15. The apparatus of claim 1, wherein the clamping members of said units have portions which are inclined forwardly in the direction of rotation of said carrier.

16. The apparatus of claim 1, wherein said first conveyor is a chain conveyor and the advancing means of said first conveyor include grippers.

* * * * *